US005272863A

United States Patent [19]

Stahlecker et al.

[11] Patent Number: 5,272,863

[45] Date of Patent: Dec. 28, 1993

[54] SPINNING MACHINE WITH SLIVER CAN TRANSFER ARRANGEMENT

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 868,230

[22] Filed: Apr. 14, 1992

[30] Foreign Application Priority Data

Apr. 16, 1991 [DE] Fed. Rep. of Germany ..... 4112351

[51] Int. Cl.[5] ..... D01H 9/18

[52] U.S. Cl. ..... 57/90; 57/281

[58] Field of Search ..... 57/281, 90; 19/159 A

[56] References Cited

U.S. PATENT DOCUMENTS

| | | | |
|---|---|---|---|
| 3,386, 134 | 6/1968 | Munroe et al. | 19/159 A |
| 3,716,979 | 2/1973 | Handschuh et al. | 19/159 A X |
| 3,816,991 | 6/1974 | Takeuchi et al. | 57/90 |
| 3,884,026 | 5/1975 | Yoshizawa et al. | 19/159 A X |
| 4,537,018 | 8/1985 | Tooka | 57/281 X |
| 4,653,263 | 3/1987 | Stahlecker et al. | 57/281 X |
| 4,977,738 | 12/1990 | Stahlecker | 57/281 |

FOREIGN PATENT DOCUMENTS

| | | | |
|---|---|---|---|
| 817572 | 10/1951 | Fed. Rep. of Germany . | |
| 107952 | 8/1974 | Fed. Rep. of Germany . | |
| 257429 | 11/1987 | Japan | 57/281 |

*Primary Examiner*—Joseph J. Hail, III

*Attorney, Agent, or Firm*—Evenson, McKeown, Edwards & Lenahan

[57] ABSTRACT

In the case of a spinning machine having a plurality of spinning stations arranged at least on one side of the machine in a row next to one another, it is provided that a depositing site for a can is assigned to each spinning station, the can containing the fiber material to be spun. For an exchange of cans, a transport device is provided which extends in the longitudinal direction of the machine and comprises a conveying run which extends in the longitudinal direction of the machine and is provided with projecting take-along cams engaging in recess of the can bottoms.

34 Claims, 3 Drawing Sheets

SPINNING MACHINE WITH SLIVER CAN TRANSFER ARRANGEMENT

BACKGROUND AND SUMMARY OF THE INVENTION

This invention relates to a spinning machine having a plurality of spinning stations arranged at least on one side of the machine in a row next to one another, a depositing site for a can containing a sliver to be spun being assigned to each spinning station.

In the case of a ring spinning machine, it is known (German Patent Document DE-Patent 817 572) to assign four to eight spinning stations to a can which correspondingly contains four to eight slivers. These cans are deposited in the machine center in an elevated manner, in which case a transport belt may serve as the depositing sites by means of which the cans deposited in several rows are to be transported to the machine end after an emptying.

It is also known (German Patent DD-Patent 107 952) to arrange in the machine center of a spinning machine a transport belt which is constructed as a link conveyor which transports cans in a continuous cycle which can in each case be transferred to two depositing sites which are each assigned to one spinning station. In the case of this construction, correspondingly small cans are required so that the sliver to be spun is transferred by means of a transfer device from large cans into small cans. The transport belt which is constructed as a link conveyor is equipped with receiving devices which each engage in a can bottom. These pin-type receiving devices are arranged at a distance which corresponds the machine spacing and to twice the machine spacing.

It is an object of the invention to construct a spinning machine of the initially mentioned type in such a manner that the supplying of full cans and the removal of empty cans is facilitated.

This object is achieved according to preferred embodiments of the invention in that a transport device for the introducing of full cans and for the removal of empty cans is provided which extends into the longitudinal direction of the spinning machine and contains a conveying run of a transport belt which extends in the longitudinal direction of the machine and is provided with projecting take-along cams which engage in recesses of the can bottoms.

By means of this development, it is possible to feed full cans to the spinning machines in which case, because of the take-along cams, they are in defined positions at which they can easily be taken over by an operator or by an automatic arrangement. During the removal, the empty cans are in defined separate positions on the transport belt so that they can also easily be removed by an operator or by an automatic arrangement and can be conveyed.

In a further development of the invention, it is provided that the transport belt is integrated in a platform which is preferably arranged above the pertaining spinning machine. In this case, it is advantageous for the conveying run of the transport belt to extend on the top side of the platform, and for the returning run of the transport belt to extend on the bottom side of the platform. Such a transport belt represents no significant obstacle which could interfere with the mobility of an operator or an automatic machine.

In a further development, it is provided that the conveying run of the transport belt is supported by a slideway. The slideway will then also take over essentially the vertical supporting of the cans so that the transport belt must essentially apply only the take-along forces.

In a further development of the invention, it is provided that the take-along cams of the transport belt have a button-shaped or lens-shaped convex design. Such take-along cams generate a satisfactory take-along connection with respect to the cans in order to guide them precisely on the transport belt and to position them. In addition, the cans nevertheless can be relatively easily slid off the transport belt by way of the take-along cams. Furthermore, such take-along cams make it possible that the cans can be transferred in a simple manner to transversely extending transport belts and can then be removed by these, particularly at the end of the transport belt.

In a further development of the invention, it is provided that the width of the transport belt is less than the diameter of the cans. In this case, it is expediently provided that guiding elements for the cans are arranged laterally of the transport belt.

Other objects, advantages and novel features of the present invention will become apparent from the following detailed description of the invention when considered in conjunction with the accompanying drawings.

DETAILED DESCRIPTION OF THE DRAWINGS

Figure 1:
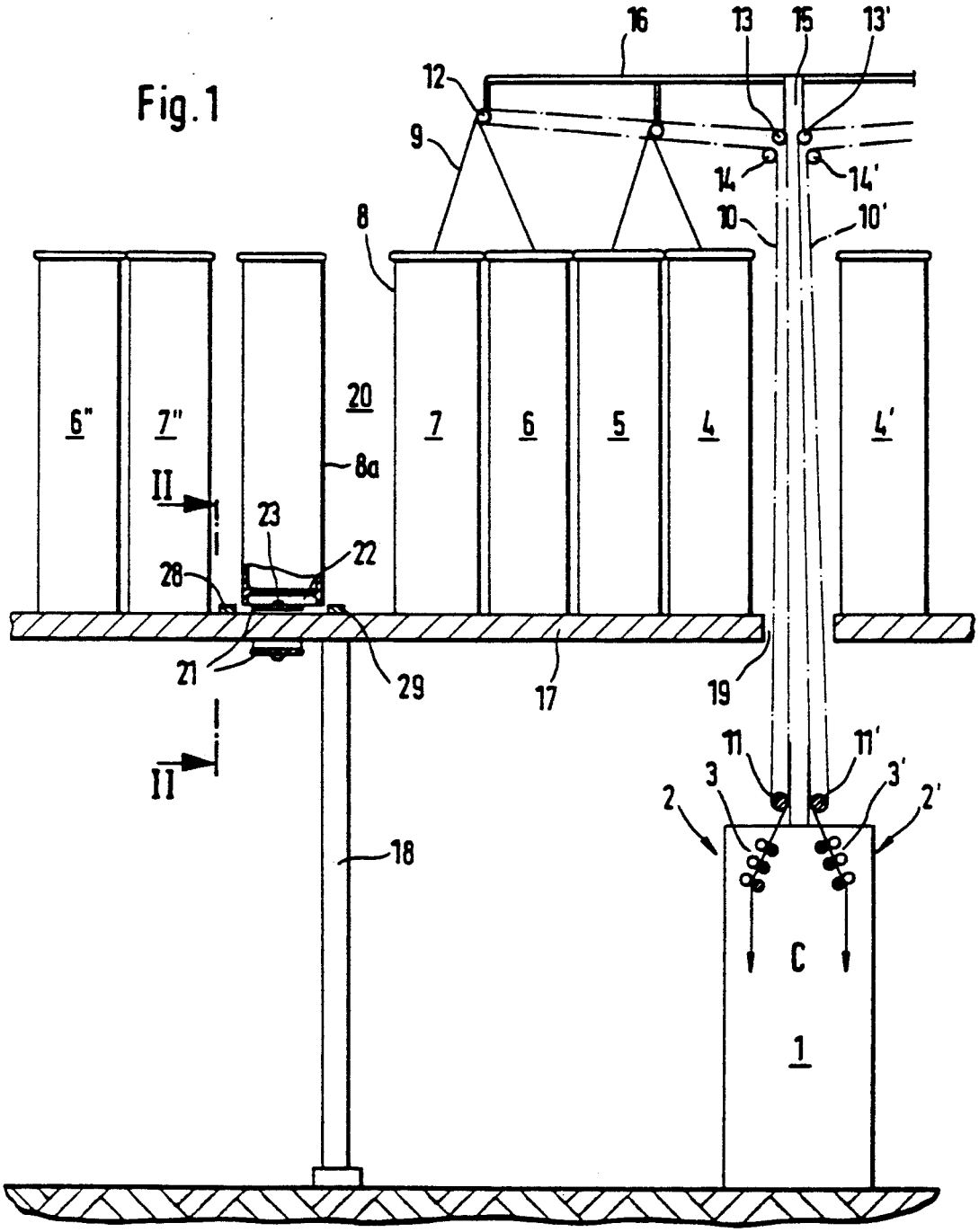
FIG. 1 is a partial cross-sectional view of a schematically illustrated spinning machine system with a platform arranged above the spinning machines which is provided with depositing sites for cans which contain the fiber material to be spun which is fed to the individual spinning stations, constructed according to a preferred embodiment of the invention.

The spinning machine system, which is only outlined in FIG. 1, comprises a plurality of spinning machines 1, such as ring spinning machines, of which only one is outlined in FIG. 1. On each side of the machine, this spinning machine 1 is provided with a plurality of spinning stations 2, 2' arranged in a row next to one another, of which only the drafting units 3, 3' are shown.

Each of these spinning stations 2, 2' spins a sliver 9 into a yarn, for which the slivers 9 are fed to the drafting units 3, 3'. The slivers 9 are fed in cans 8 which are deposited above the spinning machine 1 on depositing sites of a platform 17. The platform 17 is supported on the ground by means of several supports 18.

In order to be able to use drafting units 3, 3' whose feeding rollers rotate at a sufficiently high rotational speed for ensuring a perfect concentricity along the whole length of the machine, relatively fine slivers 9 are processed; that is, slivers 9 of sizes of from approximately Nm 0.4 to approximately Nm 0.8. In order to be able to feed these fine slivers 9 without the risk of faulty drafts to the drafting units 3, 3' from the cans 8 deposited in several rows 4, 5, ,6, 7; 4', 5', 6', 7', special guiding devices are provided. These guiding devices comprise guiding belts 10 which, by means of an approximately horizontal arm, project into the area above the rows 4 to 7 of the cans 8. The slivers 9 are placed on these guiding belts 10 and transported to the machine center. In the machine center, the guiding belts 10 are deflected downwards and are guided to the drafting units 3, 3' through a recess 19 of the platform 17. In the area of the essentially vertical run of the guiding belts 10, additional guiding devices, which are not shown, are provided in the form of skids or additional guiding belts, which hold the slivers 9 securely on the guiding belts 10.

The guiding belts 10, 10' are guided by means of deflection pulleys 11, 12; 13, 14; 11', 12', 13', 14' with the above-mentioned angular course. The guiding pulleys 11, 11', which are situated in the area of the inlet side of the drafting units 3, 3', are driven in a manner not shown in detail, for the purpose of which these guiding pulleys 11, 11' are arranged on a drivable shaft extending through in the longitudinal direction of the machine. The guiding pulleys 12, 13, 14 are held on a frame which has masts projecting upwards from the machine center, of which arms 16 follow which project in the area of the upper end toward the rows of cans 4, 5, 6, 7.

Figure 2:
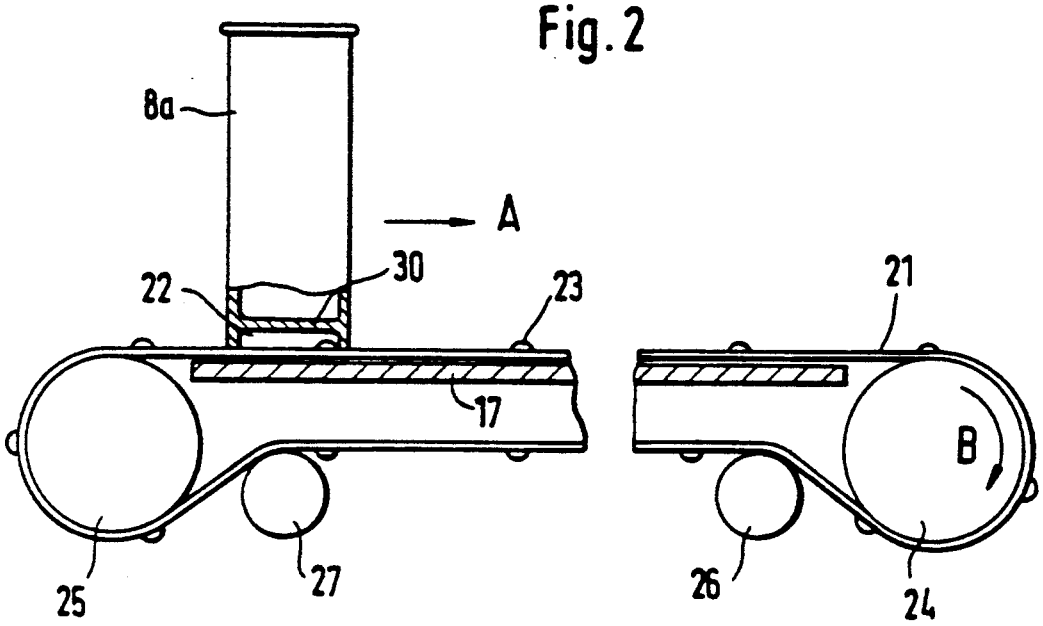
FIG. 2 is a partial sectional view along Line II—II of FIG. 1.
Figure 4:
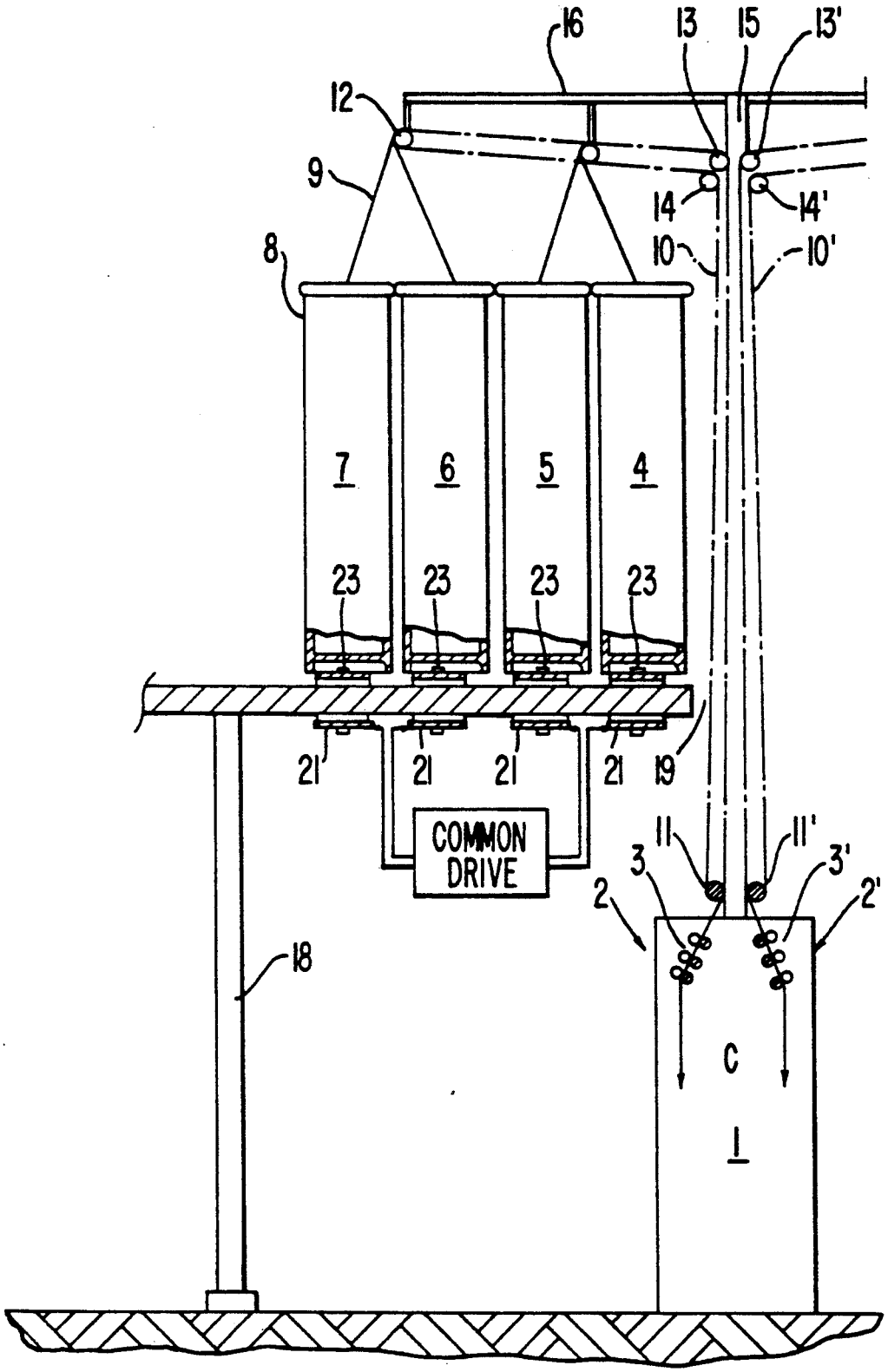
FIG. 4 is a partial cross-sectional view of a spinning machine system according to another embodiment of the invention.

Between the mutually facing, outer rows 7, 7', 7'' of two adjacent spinning machines 1, one operating aisle 20 respectively is left open. In the area of this operating aisle 20, a transport device is situated by means of which full cans 8 can be fed to the individual depositing sites of rows 4 to 7, 4' to 7', and 4'' to 7'' and empty cans **8*a* can be removed. This transport device comprises a transport belt 21 which extends in the longitudinal direction of the machine (direction of arrow A) along the depositing sites. As shown particularly in FIGS. 1 and 2, this transport belt 21 is integrated into the platform 17. A run, which conveys the cans 8*a*, is slidingly guided on a sliding surface of the platform 17. The returning run travels back below the platform 17, in which case it is guided at the machine end around respective deflection pulleys 25 of which one is drivable. In this case, a common drive may be provided for several transport belts 21, in which case it would then, however, be expedient for the individual transport belts to be connectable separately by means of couplings or the like. A common drive is schematically illustrated in the embodiment of FIG. 4, although this common drive can also be used with the embodiment of FIG. 1. In the area of the platform 17, the returning run of the transport belt 21 is guided by rollers 26, 27** so that, on the one hand, it is sufficiently tensioned and, on the other hand, it does not hang through in the downward direction.

In a regularly spaced manner, the transport belt 21 is provided with take-along cams 23 which have a button-type or lens-type convex design and project from the transport belt 21 toward the outside; that is, upwards in the area of the conveying run. These take-along cams 23, which are fastened on the transport belt 21, reach behind the inner lower edge 22 of the cans **8*a* which are normally provided with a bottom 30 which is offset in the upward direction. The take-along cams 23 are relatively flat; that is, they project from the transport belt 21 only at a height of approximately 5 mm. These take-along cams 23 are sufficient for ensuring a secure taking-along. In addition, these take-along cams 23 permit a relatively easy sliding of the cans 8*a* off the transport belt 21 as well as a simple taking-over and also transfer in the area of the ends of the transport belt 21 because then the take-along cams 23, in addition, also move out of the area of the edge 22 of the cans 8*a*. The cans 8*a* can then easily be taken over by transport belts extending transversely with respect to the transport belt 21**.

Figure 3:
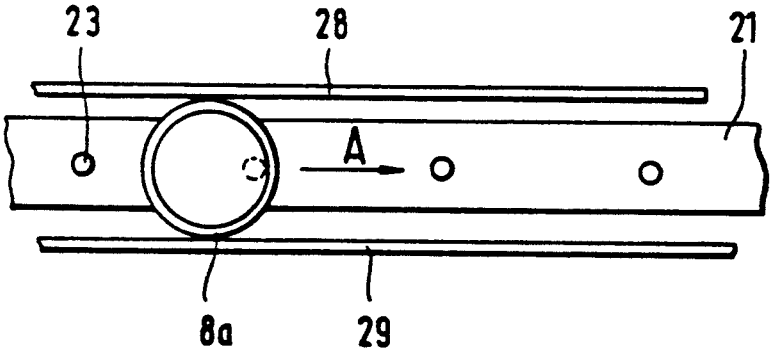
FIG. 3 is a top view of the partial section according to FIG. 2.

As illustrated in FIG. 3, a transport belt 21 is sufficient which has a width which is less than the diameter of the cans **8*a*. This development also results in a sufficiently secure positioning. However, this positioning of the cans 8*a* can still be improved by that fact that guide rails 28, 29 are arranged laterally of the transport belt 21 which have a mutual distance that is slightly, for example, 10 mm, larger than the diameter of the cans 8*a***.

The take-along cams 23 are arranged at a distance from one another which corresponds to the spacing of the machine; that is, to the width of a spinning station or, since, as a rule, the cans **8*a* have a larger diameter than the machine spacing, to a multiple of this machine spacing. As a result, it is possible, by means of the transport belt 21, to position the cans 8*a* precisely and to align them with the respective spinning station 2; that is, to the depositing site pertaining to this spinning station 2, 2'**.

In the embodiment illustrated in FIG. 4, it is provided that a separate transport belt 21 is assigned to each row 4, 5, 6, 7 for the cans 8 so that these transport belts 21 will then also represent the depositing sites for the cans 8. During the spinning operation, the cans 8 will then remain on these transport belts 21.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A spinning machine having a plurality of spinning stations arranged at least on one side of the machine in a row next to one another, a depositing site for a can containing a sliver to be spun being assigned to each spinning station, wherein a transport device for the feeding of full cans and for the removal of empty cans is provided which extends in the longitudinal direction of the spinning machine and comprises a conveying run of a transport belt which extends in the longitudinal direction of the machine and is provided with projecting take-along cams engaging in recesses of the can bottoms, wherein said take-along cams are substantially continuously curved in profile such that the cans are removable from the transport belt by lateral sliding of the cans over the take-along cams.

2. A spinning machine according to claim 1, wherein the transport belt is integrated into a platform which is arranged above the pertaining spinning machine.

3. A spinning machine according to claim 2, wherein the conveying run of the transport belt extends on the top side of the platform, and wherein the returning run of the transport belt extends on the bottom side of the platform.

4. A spinning machine according to claim 2, wherein the conveying run of the transport belt is supported by a slideway.

5. A spinning machine according to claim 1, wherein the conveying run of the transport belt extends on the top side of the platform, and wherein the returning run of the transport belt extends on the bottom side of the platform.

6. A spinning machine according to claim 5, wherein the conveying run of the transport belt is supported by a slideway.

7. A spinning machine according to claim 5, wherein the take-along cams are arranged at a distance from one another which corresponds to a single spacing of the spinning stations.

8. A spinning machine according to claim 7, wherein the width of the transport belt is less than the diameter of the cans.

9. A spinning machine according to claim 5, wherein the width of the transport belt is less than the diameter of the cans.

10. A spinning machine according to claim 5, wherein guiding elements for the cans are arranged laterally of the transport belt.

11. A spinning machine according to claim 5, wherein at least one transport belt respectively is arranged in operating aisles between the depositing sites for cans of several machines, a common drive being provided for several transport belts.

12. A spinning machine according to claim 5, wherein the take-along cams are arranged at a distance from one another which corresponds to a multiple of the spacing of the spinning stations.

13. A spinning machine according to claim 1, wherein the conveying run of the transport belt is supported by a slideway.

14. A spinning machine according to claim 1, wherein the take-along cams are arranged at a distance from one another which corresponds to a single spacing of the spinning stations.

15. A spinning machine according to claim 14, wherein the width of the transport belt is less than the diameter of the cans.

16. A spinning machine according to claim 1, wherein the width of the transport belt is less than the diameter of the cans.

17. A spinning machine according to claim 1, wherein guiding elements for the cans are arranged laterally of the transport belt.

18. A spinning machine according to claim 1, wherein at least one transport belt respectively is arranged in operating aisles between the depositing sites for cans of several machines, a common drive being provided for several transport belts.

19. A spinning machine according to claim 1, wherein the take-along cams are arranged at a distance from one another which corresponds to a multiple of the spacing of the spinning stations.

20. A spinning machine according to claim 1, wherein the take-along cams have a maximum height of only approximately 5 mm.

21. A spinning machine having a plurality of spinning stations arranged at least on one side of the machine in a row next to one another, a depositing site for a can containing a sliver to be spun being assigned to each spinning station, wherein a transport device for the feeding of full cans and for the removal of empty cans is provided which extends in the longitudinal direction of the spinning machine and comprises a conveying run of a transport belt which extends in the longitudinal direction of the machine and is provided with projecting take-along cams engaging in recesses of the cam bottoms wherein the take-along cams of the transport belt have lens-shaped convex design.

22. A spinning machine having a plurality of spinning stations arranged at least on one side of the machine in a row next to one another, a depositing site for a can containing a sliver to be spun being assigned to each spinning station, wherein a transport device for the feeding of full cans and for the removal of empty cans is provided which extends in the longitudinal direction of the spinning machine and comprises a conveying run of a transport belt which extends in the longitudinal direction of the machine and is provided with projecting take-along cams engaging in recesses of the can bottoms;

wherein the transport belt is integrated into a platform which is arranged above the pertaining spinning machine;

wherein the conveying run of the transport belt extends on the top side of the platform, and wherein the returning run of the transport belt extends on the bottom side of the platform; and wherein the take-along cams of the transport belt have a lens-shaped convex design.

23. A spinning machine according to claim 22, wherein the take-along cams are arranged at a distance from one another which corresponds to a single spacing of the spinning stations.

24. A spinning machine according to claim 22, wherein the take-along cams are arranged at a distance from one another which corresponds to a multiple of the spacing of the spinning stations.

25. A spinning machine having a plurality of spinning stations arranged at least on one side of the machine in a row next to one another, a depositing site for a can containing a sliver to be spun being assigned to each spinning station, wherein a transport device for the feeding of full cans and for the removal of empty cans is provided which extends in the longitudinal direction of the spinning machine and comprises a conveying run of a transport belt which extends in the longitudinal direction of the machine and is provided with projecting take-along cams engaging in recesses of the can bottoms, wherein the transport belt forms the depositing site for each can such that the cans remain on the transport belt during spinning operation.

26. A spinning machine according to claim 25, wherein the take-along cams are arranged at a distance from one another which corresponds to a multiple of the spacing of the spinning stations.

27. A spinning machine according to claim 25, wherein the conveying run of the transport belt extends on the top side of a platform, and wherein the returning run of the transport belt extends on the bottom side of the platform.

28. A spinning machine according to claim 25, wherein the conveying run of the transport belt is supported by a slideway.

29. A spinning machine according to claim 25, wherein the take-along cams of the transport belt have a lens-shaped convex design.

30. A spinning machine according to claim 25, wherein the take-along cams are arranged at a distance from one another which corresponds to a single spacing of the spinning stations.

31. A spinning machine according to claim 25, wherein the width of the transport belt is less than the diameter of the cans.

32. A spinning machine according to claim 25, wherein guiding elements for the cans are arranged laterally of the transport belt.

33. A spinning machine according to claim 25, wherein at least one transport belt respectively is arranged in operating aisles between the depositing sites for cans of several machines, a common drive being provided for several transport belts.

34. A spinning machine according to claim 25, wherein the take-along cams are arranged at a distance from one another which corresponds to a multiple of the spacing of the spinning stations.

* * * * *